US006619196B2

(12) United States Patent
Dorner

(10) Patent No.: US 6,619,196 B2
(45) Date of Patent: Sep. 16, 2003

(54) APPARATUS FOR PRINTING GOLF TEES

(75) Inventor: Frank Dorner, Vienna (AT)

(73) Assignee: Kunz GmbH, Vienna (AT)

( * ) Notice: Subject to any disclaimer, the term of this patent is extended or adjusted under 35 U.S.C. 154(b) by 0 days.

(21) Appl. No.: 10/057,078

(22) Filed: Jan. 24, 2002

(65) Prior Publication Data

US 2002/0056378 A1 May 16, 2002

(30) Foreign Application Priority Data

Jan. 25, 2001 (DE) ..... 101 03 343

(51) Int. Cl.[7] ..... B41F 17/28; B41F 17/18

(52) U.S. Cl. ..... 101/35; 101/44; 101/474; 347/4

(58) Field of Search ..... 101/35, 37, 41, 101/44, 474, 480; 347/2, 4

(56) References Cited

U.S. PATENT DOCUMENTS 1,369,570 A * 2/1921 Stiles ..... 101/35
1,989,898 A * 2/1935 Trutner ..... 101/35
3,447,659 A * 6/1969 Mumma ..... 198/456
4,019,187 A * 4/1977 Omori et al. ..... 347/4
5,671,667 A * 9/1997 Simmet ..... 101/35
6,290,616 B1 * 9/2001 Evans et al. ..... 473/399

* cited by examiner

*Primary Examiner*—Leslie J. Evanisko
(74) *Attorney, Agent, or Firm*—Flynn, Thiel, Boutell & Tanis, P.C.

(57) ABSTRACT

An apparatus for printing on golf tees or other conical objects. The apparatus includes a singler from which the objects are discharged one-by-one. From the singler, the objects are deposited onto a rack. In some versions of the invention, the singler vibrates. The rack is mechanically separate from the singler so that the vibrations of the singler are not transmitted to the rack. A conveyor adjacent the rack individually picks up each object. More particularly, the object is held between a pair of opposed entraining pins on the conveyor. As the object moves horizontally along the conveyor, it is passed underneath a printer that prints on the object.

20 Claims, 2 Drawing Sheets

APPARATUS FOR PRINTING GOLF TEES

FIELD OF THE INVENTION

This invention relates to an apparatus for printing golf tees and the like.

BACKGROUND OF THE INVENTION

Golf tees are the pegs on which golf balls are placed to be struck at the beginning of play. A tee has a shaft with a point which is set into the earth, and a usually flaring head with a depression in which the golf ball is placed. Tees are usually made of wood or plastic.

Tees are frequently provided with advertising and similar prints. This is generally done using ink dabber printing, for which an elaborate block must be produced, so that it is only suitable for large series.

However, there is also a need to print tees with the name of a company, the name of the particular golfer or the like, i.e. in a small piece number with frequently changing texts.

SUMMARY OF THE INVENTION

The object of the invention is therefore to provide a simply constructed, easily operated, efficient apparatus for printing golf tees.

According to the invention, a rack for forming a row of tees is provided. The lined-up tees are suspended between two rails which form a longitudinal slit. The distance between the rails, or the width of said slit, is greater than the diameter of the shaft but smaller than the diameter of the head of the tee, so that the shaft of the tee hangs downward with the point through the slit or between the rails, while the head of the tee rests on both rails or the side edges of the slit.

The conveying means preferably used is a belt or chain conveyor, i.e. the carrying or traction device of the conveying means is formed by a band or belt or one or more chains.

Entrainers are disposed in pairs on the carrying device at a distance in the longitudinal or conveying direction which is greater than the length of a tee, so that the tees can be deposited on the carrying device at a distance apart in the longitudinal direction.

The entrainers of each pair are at a distance apart which is greater than the diameter of the shaft of the tee but smaller than the diameter of its head.

The turning end of the conveying means is so disposed relative to the rack, and the conveying means has such a circulating direction, that the particular entrainer pair at the turning end is moved from the bottom to the top between the rails of the rack to engage under the head of the foremost tee of the row facing the turning end and place it during its further transport to the printing apparatus on the upper run, i.e. the upper section of the conveying means.

The turning end can be formed by a deflection roller for example in a belt conveyor, or a guide wheel, for example a guide gearwheel, e.g. in a chain conveyor.

The preferred printing apparatus according to the invention is an ink jet printer since it firstly can readily print on round, nonplane surfaces, and secondly can be driven individually and easily with a PC or similar data processing system. That is, the invention permits even very small series to be printed in simple fashion, if desired each tee differently.

The slanted arrangement of the rails of the rack, i.e. when their lower ends face the turning end of the conveying means, permits the rails of the rack to be formed as a chute.

At the end of the rails of the rack facing the turning end of the conveying means, a stop is provided for the foremost tee. Said stop can be formed e.g. by bending up the ends of the rails or the like. It is only essential that the stop not prevent the foremost tee of the rack from being received by the particular entrainer pair of the conveying means.

For each tee to be positioned precisely under the printing apparatus, the conveying means is preferably formed by a belt or at least one chain on which links are fastened from which the entrainers protrude, on the one hand, and which each have a depression, on the other hand, so that they form a channel extending in the longitudinal conveying direction on the upper run of the conveying means. The depressions can be of V shape in cross section. Additionally, they can also be formed with different heights in the longitudinal direction. This causes the tees to be disposed in the middle or in a defined position in the longitudinal direction as well as horizontally in the optimal printing plane, based on the width of the traction device.

Furthermore, for exact positioning of the tees under the printing apparatus a presser is provided between the turning end and the printing apparatus for lightly pressing the tees so that tees whose heads are not lying against the entrainer pair are pulled with their heads toward the entrainer pair. After that a sensor is mounted for reporting the presence of a tee and the start position for printing to the printing unit.

To permit automatic operation of the apparatus, a tee singling device is preferably provided from which the tees are supplied to the rack. The singling device may be formed as a bowl or similar vessel with a coil on the inside wall which rises upward from the bottom. The vessel is set in rotary vibrations about the center axis of the coil by a vibrating device such that the tees travel upward jerkily on the coil. The tees are thereby aligned in the longitudinal direction, i.e. tees not disposed in the longitudinal direction of the coil are either not received by the coil or drop off it again to the vessel bottom. Furthermore, a suitable installation (e.g. a taper of the coil) ensures that only one tee after the other is transported.

The vibrating device can have for example one or more electromagnets which attract the bowl contrary to the force of a spring, whereby when the electromagnet or electromagnets are turned off the springs abruptly turn the bowl a piece so that the tees are moved upward on the coil according to the law of inertia.

At the upper end of the coil two rails are preferably fastened side by side to form a vibrating conveyor that moves the tees to the rack. The rails of the supply device are preferably disposed on a slant in order to form a chute for the tees to the rack. Said rails simultaneously cause the tees to be all suspended in identical alignment with their heads upward, no matter in which direction they arrive at the end of the coil.

A sensor is preferably provided on the rack for switching off or stopping the singling device at a predetermined number of tees in the rack, and switching it on again when there is less than a predetermined number of tees. The rack is mechanically unconnected with the singler so that no vibration of the vibrating conveyor is transmitted to the rack and the conveying device.

The inventive apparatus is conceived primarily for golf tees. However, it can be used equally well for printing other nail-like, cylindrical, conic or similar elongate objects, e.g. prismatic elongate objects such as pencils. If no suitably formed head of the tee or object to be printed is available, another inventive embodiment is provided such that the alignment is effected by suitable installations in the vibrating conveyor. The objects thus already aligned can then be supplied on a chute in the form of a channel likewise to the conveyer belt, in this case on the upper run area.

BRIEF DESCRIPTION OF THE DRAWINGS

In the following an example of the invention will be explained in more detail with reference to the drawing, in which.

DETAILED DESCRIPTION

Figure 1:
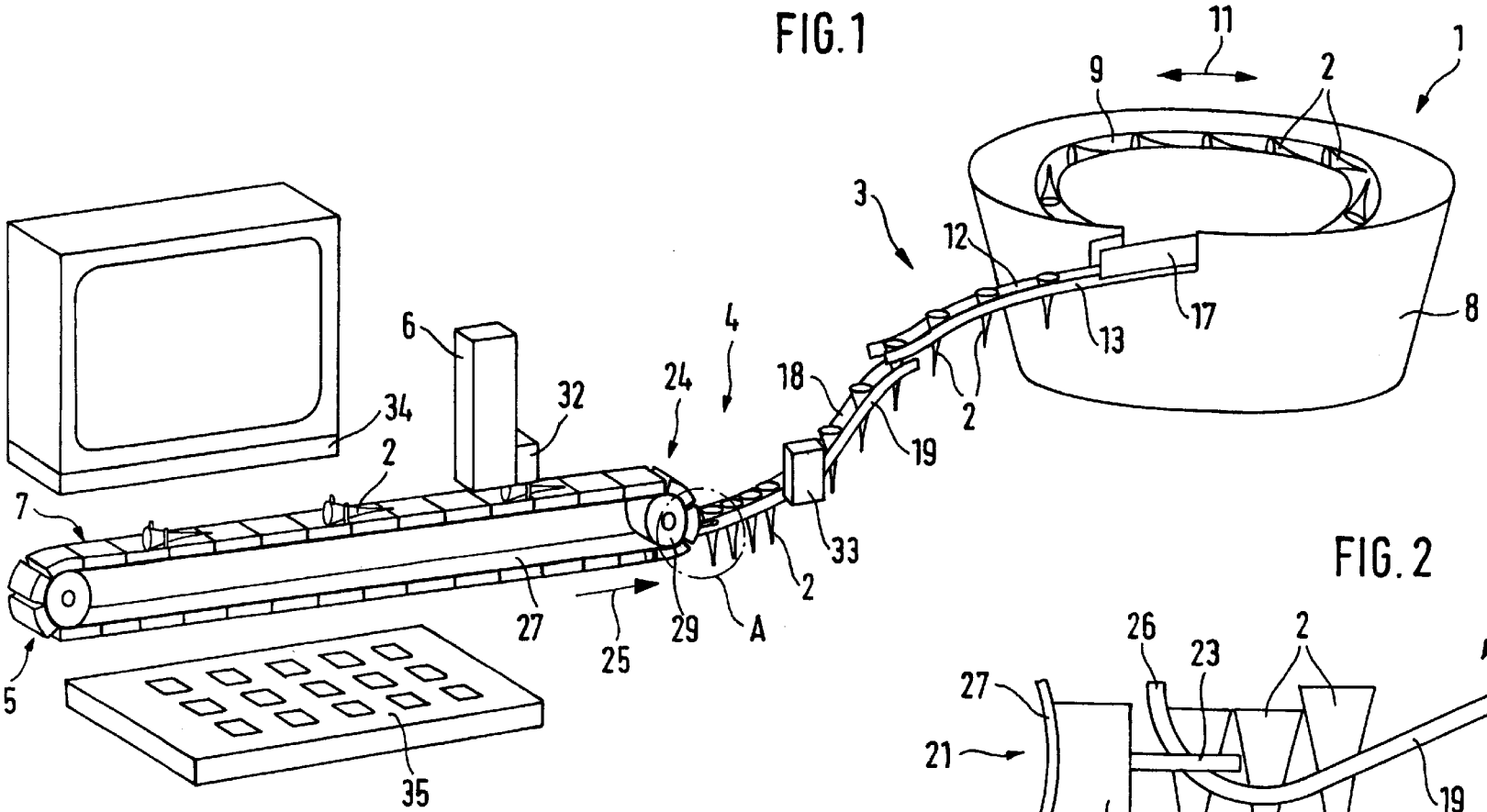
FIG. 1 shows a perspective view of the apparatus.

The apparatus has singling device 1 for tees 2, supply device 3 for supplying tees 2 from singling device 1 to rack 4, circulating, endless conveying means 5 and printing apparatus 6 above upper section or run 7 of conveying means 5.

Tee singling device 1 has bowl-shaped vessel 8 containing an invisible supply of tees 2 to be singled. On the inside wall of vessel 8 there is coil 9 having one to two turns and rising upward from the bottom of vessel 8 to supply device 3. Vessel 8 with coil 9 is set by a vibrating device (not shown) in rotary vibrations according to arrow 11 such that tees 2 on coil 9 travel upward jerkily lying in the longitudinal direction of the coil. The coil tapers at a point in the upper area such that only one tee after the other can pass said point. If two tees arrive in this area simultaneously, one of them is thrown off again.

Supply device 3 has two rails 12, 13 which are fastened to bowl 8 at the upper end of coil 9. As indicated in particular by FIG. 3, each tee 2 consists of cylindrical or slightly conic shaft 14 with point 15 whose upper end flares to head 16 with depression 20. When foremost tee 2 facing rails 12, 13 on coil 9 leaves coil 9 during further transport (regardless of whether it arrives head or point first), head 16 of said tee 2 is caught by the two rails 12, 13. This process is supported by guide surfaces 17 which are fastened to vessel 8 and extend from the upper end of the coil in the direction of rails 12, 13 on both sides thereof.

Rails 12, 13 extend on a slant downward from the upper end of the coil to rack 4, thereby forming a chute.

Rack 4 has two rails 18, 19 lying side by side to form a row of tees 2. Tees 2 rest with their heads 16 on rails 18, 19 so that they hang downward with their points 15 between rails 18, 19.

Rails 12, 13 of supply device 3 fastened to vessel 8 extend over rails 18, 19 of rack 4, in such a way that tees 2 dropping down at the end of rails 12, 13 are caught with their heads 16 by rails 18, 19 of rack 4.

The distance of rails 12, 13 of supply device 3 from rails 18, 19 of rack 4 in the vertical direction is substantially smaller than the length of shaft 14 with point 15 of tee 2, so that shaft 14 of tee 2 is moved on rails 12, 13 between rails 18, 19 of rack 4 before tee 2 drops down from rails 12, 13 of supply device 3 onto rails 18, 19 of rack 4. The upper end of rails 18, 19 of rack 4, i.e. the end facing singling device 1, and/or the lower end of rails 12, 13 of supply device 3 facing conveying means 5 can widen in a funnel shape for receiving shaft 14 or for dropping tees 2 onto rails 18, 19 of rack 4.

Figure 3:
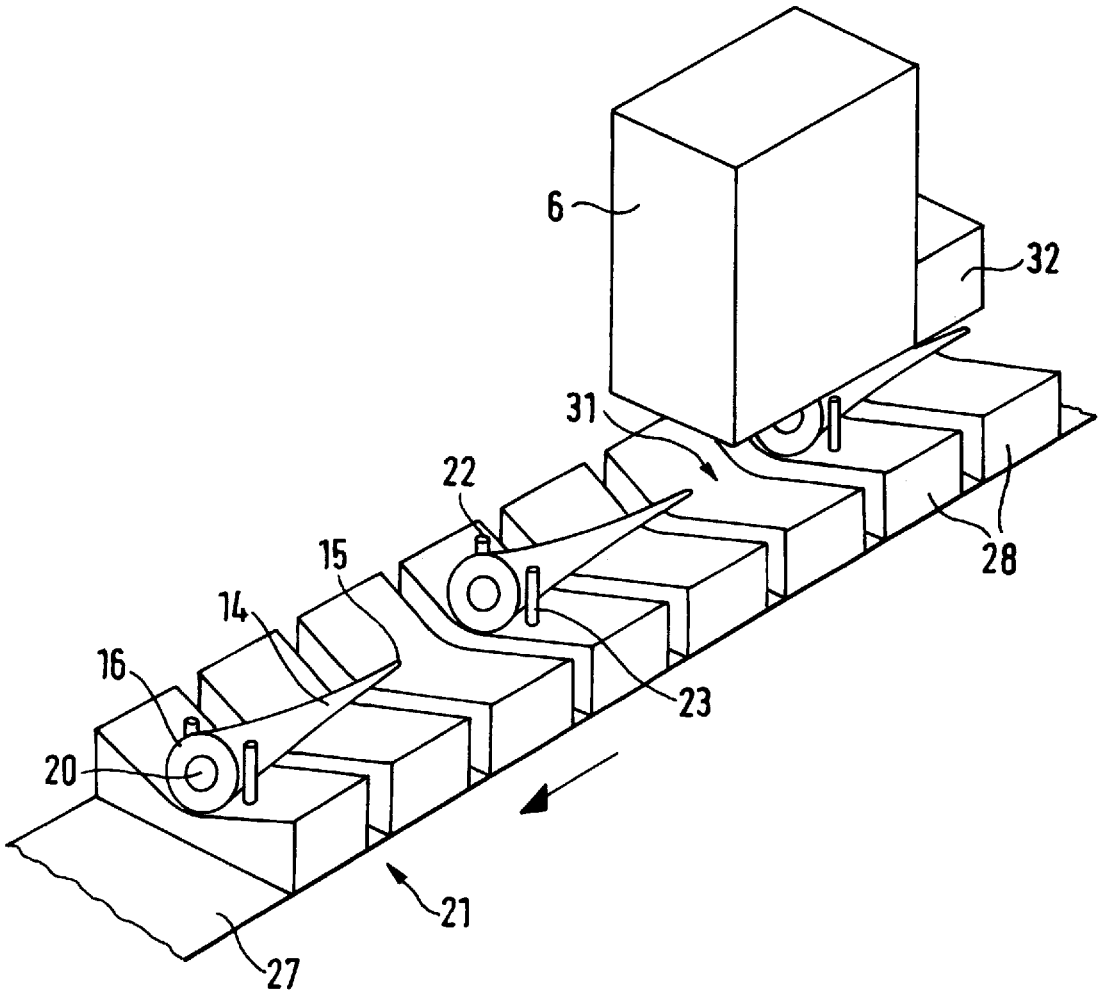
FIG. 3 shows a perspective view of a part of the upper run or section of the conveying means.

Conveying means 5 has carrying device 21 which is provided with entrainers 22, 23 disposed side by side in pairs (FIG. 3). Entrainer pairs 22, 23 are disposed at a distance in the longitudinal direction of carrying device 21 which is greater than the length of one tee 2.

Rails 18, 19 of rack 4 are disposed on a slant in order to form a chute for lined-up tees 2.

Figure 2:
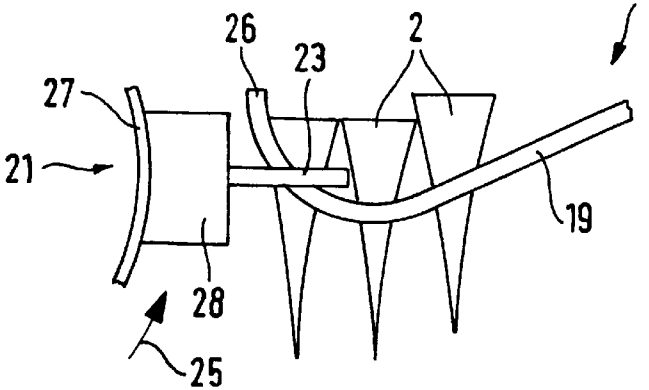
FIG. 2 shows an enlarged view of area A in FIG. 1 in a side view.

Turning end 24 is disposed opposite the lower end of rails 18, 19 of rack 4. Carrying device 21 of conveying means 5 has the circulating direction indicated by arrow 25. Entrainers 22, 23 of each pair, which can be formed as fingers or pins, are at a distance apart which is smaller than the diameter of head 16 of tee 2 but greater than the diameter of shaft 14. The outsides of entrainers 22, 23 are so spaced, or the end of rails 18, 19 so tapered, that end 26 of rails 18, 19 fits between the entrainers when the entrainers are moved from the bottom to the top according to circulating direction 25 outside rails 18, 19 to engage under head 16 of foremost tee 2 of the row (FIG. 2). Tee 2 is then placed during its further transport in circulating direction 25 to printing apparatus 6 onto upper run 7 of carrying device 21.

Lower end 26 of rails 18, 19 of rack 4 is tapered and interconnected in order to form a stop for foremost tee 2.

Conveying means carrying-device 21 can be formed by belt 27 on which mutually articulated links 28 are fastened. End 24 of carrying device 21 is fitted over a deflection roller 29 for belt 27. At a suitable point on the conveying device an incremental encoder is mounted for reporting the particular adjusted transport speed to the printing device and thus permitting adjustment of the printing speed for optimizing the printed image.

Links 28 from which pin-shaped entrainers 22, 23 protrude are provided in the middle with V-shaped depressions 31, thereby forming on upper run 7 a channel extending in the conveying direction in which tees 2 lie. The channel has a depression in the area of the head of the tee in order to obtain a printing plane as flat as possible on the basically conic tee shaft.

Between turning end 24 or deflection roller 29 and printing apparatus 6 there is provided presser 32 in the form of a brush which presses on tees 2 so that tee 2 lying with its head 16 too far in front is slowed down and thus pulled with its head 16 onto particular entrainer pair 22, 23. Immediately after presser 32, a sensor is also mounted for checking the presence of a tee as well as its position and reporting this to the printing unit.

Further sensor 33, for example a light barrier, is provided on the area of rack 4 facing away from conveying means 5. Sensor 33 detects when a predetermined number of tees 2 is located on rack 4. Sensor 33 then stops the vibrating device of singling device 1 and switches it on again as soon as there is less than the predetermined number of tees 2 again on rack 4.

Printing apparatus 6 is formed by an ink jet printer which is driven by personal computer 34 with a screen and keyboard 35.

What is claimed is:

1. An apparatus for printing conical shaped objects, each object having a head portion with a wide diameter, a pointed tail portion with a narrow diameter and a length, said apparatus comprising:

a rack for holding a row of objects, said rack having two rails that are selectively spaced apart a sufficient distance so that object heads rest on said rails and the object tails extend downward from said rails;

a conveying means including an endless carrying device and a plurality of pairs of entrainers, each pair of entrainers being disposed side-by-side, and said pairs of entrainers being longitudinally spaced apart from each other on said carrying device a distance greater then the length of the objects, said conveying means also having a horizontally oriented upper run and a turning end; and a printing apparatus positioned to print said objects when said objects are on the upper run of said conveying means carrying device, wherein said conveying means is positioned so that the turning end of said conveying means is positioned so that, when each said pair of entrainers is at the turning end and moves vertically from a bottom position to the upper run, said pair of entrainers engage under the head of a lead object in the row of objects to place the lead object on the upper run of said conveying means to transport the lead object to said printing apparatus.

2. The apparatus according to claim 1, wherein said printing apparatus is an ink jet printer.

3. The apparatus according to claim 2, wherein said ink jet printer is adapted to be driven by a personal computer.

4. The apparatus according to claim 1, wherein said rails of said rack are disposed on a slant to form a chute for the objects and said rails are directed toward the turning end of said conveying means.

5. The apparatus according to claim 1, wherein a stop for the lead object is provided at an end of said rails facing the turning end of said conveying means.

6. The apparatus according to claim 1, wherein said conveying means carrying device has links fastened thereto from which said entrainers protrude and each said link is shaped to have a depression so that said links on the upper run of the conveying means form a channel extending in the conveying direction for receiving the objects.

7. The apparatus according to claim 1, wherein a singling device is provided from which the objects are supplied to said rack.

8. The apparatus, according to claim 7, wherein a device for supplying the objects from the singling device to said rack is provided which has two rails on which the objects rest with their heads and between which the objects hang downward with said rails of said supply device being positioned to extend over said rails of said rack such that the objects leaving said rails of said supply device are received by said rails of said rack.

9. The apparatus according to claim 7, wherein said singling device is formed by a vessel with a coil rising from a bottom portion and a vibrating device which sets said vessel in oscillating rotary vibrations such that said objects on said coil travel upward in an orientation of said coil.

10. The apparatus according to claim 9, further including a device for supplying the objects from said singling device to said rack, said supply device comprising two rails on which the heads of the objects rest and from which the tails of the objects hang downward, said supply device rails having first and second ends, the first ends of said supply device rails being fastened to an upper end of said singling device coil so that a head of a foremost object on said coil facing said rails is trapped during transport from said coil by said supply device rails, and the second ends of said supply device rails of the supply device extend over said rack such that the head of the objects leaving said rails of said supply device are received by said rails of said rack.

11. The apparatus according to claim 10, wherein said rails of said supply device are disposed on a slant to form a chute for the objects in the direction of said rack.

12. The apparatus according to claim 10, wherein said singling device and supply device rails vibrate and alignment of the objects to be printed is effected by installations on said supply device rails.

13. The apparatus of claim 10, wherein said singling device, said supply device, said rack, said conveying means and said printing apparatus are configured and dimensioned so that the objects printed by said printing apparatus are golf tees.

14. The apparatus of claim 7, wherein said singling device, said rack, said conveying means and said printing apparatus are configured and dimensioned so that the objects supplied by said singling device and conveyed to said printing apparatus for printing are golf tees.

15. The apparatus of claim 7, further including a sensor that determines the number of objects on said rack, said sensor being configured to generate a signal that causes said singling device to stop supplying objects when more than a select number of objects are on said rack.

16. The apparatus of claim 7, wherein:

said singling device vibrates; and said singling device is mechanically separated from said rack so that vibrations generated by said singling device are not transmitted to said rack.

17. The apparatus of claim 16, wherein said singling device, said rack, said conveying means and said printing apparatus are configured and dimensioned so that the objects printed by said apparatus are golf tees.

18. The apparatus of claim 6, wherein said rack, said conveying means, including said links, and said printing apparatus are configured and dimensioned so that the objects printed by said apparatus are golf tees.

19. The apparatus according to claim 1, wherein a presser is provided between the turning end of said conveying means and said printing apparatus for pressing on the objects such that an object having a head that is not lying against an associated said entrainer pair is pulled so that the head is moved toward said entrainer pair.

20. The apparatus of claim 1, wherein said rack, said conveying means and said printing apparatus are configured and dimensioned so that the objects printed by said apparatus are golf tees.

* * * * *